United States Patent [19]

Spiegelberg

[11] 4,181,225

[45] Jan. 1, 1980

[54] WET-TISSUE PACK

[75] Inventor: Hans Spiegelberg, Taby, Sweden

[73] Assignee: Salva S.A., Switzerland

[21] Appl. No.: 526,850

[22] Filed: Nov. 25, 1974

Related U.S. Application Data

[62] Division of Ser. No. 329,967, Feb. 6, 1973, Pat. No. 4,143,762.

[30] Foreign Application Priority Data

Feb. 22, 1972 [SE] Sweden ..... 2119/72

[51] Int. Cl.[2] ..... B65D 85/00

[52] U.S. Cl. ..... 206/494; 206/449; 221/63

[58] Field of Search ..... 206/494, 449; 221/48, 221/46, 63, 55

[56] References Cited

U.S. PATENT DOCUMENTS

| | | | |
|---|---|---|---|
| 2,923,435 | 2/1960 | Chaplin | 206/494 |
| 3,119,516 | 1/1964 | Donovan | 206/494 |
| 3,684,086 | 8/1972 | Harrison | 206/449 |
| 3,819,043 | 6/1974 | Harrison | 206/449 |

*Primary Examiner*—William T. Dixson, Jr.

[57] ABSTRACT

Cleansing tissues arranged in a stack in pack or box which is provided in its upper surface with an opening for removal of the tissues located therein. The tissues are each folded to form in cross section a substantially planar center portion having two substantially Z-shaped sections along each edge, and to be stacked flat one on another.

2 Claims, 2 Drawing Figures

WET-TISSUE PACK

RELATED APPLICATION

The present application is a division of copending Ser. No. 329,967 filed Feb. 6, 1973 now U.S. Pat. No. 4,143,762, containing subject matter originally disclosed therein. Reference may be made to the foregoing application for all details shown and described therein.

BACKGROUND OF INVENTION

The present invention relates to a wet-tissue pack and in particular to the method and form of folding each of a plurality of moistened, so-called wet-tissues, for stacking in such pack.

The invention can be used with advantage for cleansing tissues, by which is meant so-called dry or wet-tissues used, inter alia, for personal hygiene, particularly when soap and water are not available. Such tissue usually consists of a cloth of paper or unwoven material, which may be impregnated with a cleansing, antiseptic solution containing a mild cleansing component, a component to return oil to the skin thus preventing it from drying out, and a bactericidal substance. It may also contain a perfume. In the parent application a box having an automatically sealable closing is disclosed for the wet-tissues which, as the name suggests, should be used when moist.

Another problem has existed in the prior art, namely, that of folding tissues so that they can assume as small an area or volume as possible, and yet remain sufficiently flat so as to be easily and conveniently stacked one upon the other or in a soft pack and furthermore be easily removed and unfolded when needed.

The tissues are folded into a narrow flat condition which enables economical stacking and formation of a pack, and which furthermore permits easily and simple removal when desired.

These objects as well as other advantages will be apparent from the following disclosure.

SUMMARY OF INVENTION

According to the present invention a package of cleansing tissues is provided comprising an outer box or pack having an opening in its upper surface for removal of the tissues. The tissues are stacked in the package one on top of each other. Each tissue is folded to form in cross section a substantially planar center portion having two substantially Z-shaped portions folded in planar engagement with the surface thereof.

The Z-shaped portions may overlie or underlie the center portion, with respect to the stack, and preferably extend to proximity with the longitudinal center line of the center portion, so as to lie in the center of the box or package and be thus easily grasped for removal.

Full details are given in the following description.

DESCRIPTION OF THE INVENTION

Figure 1:
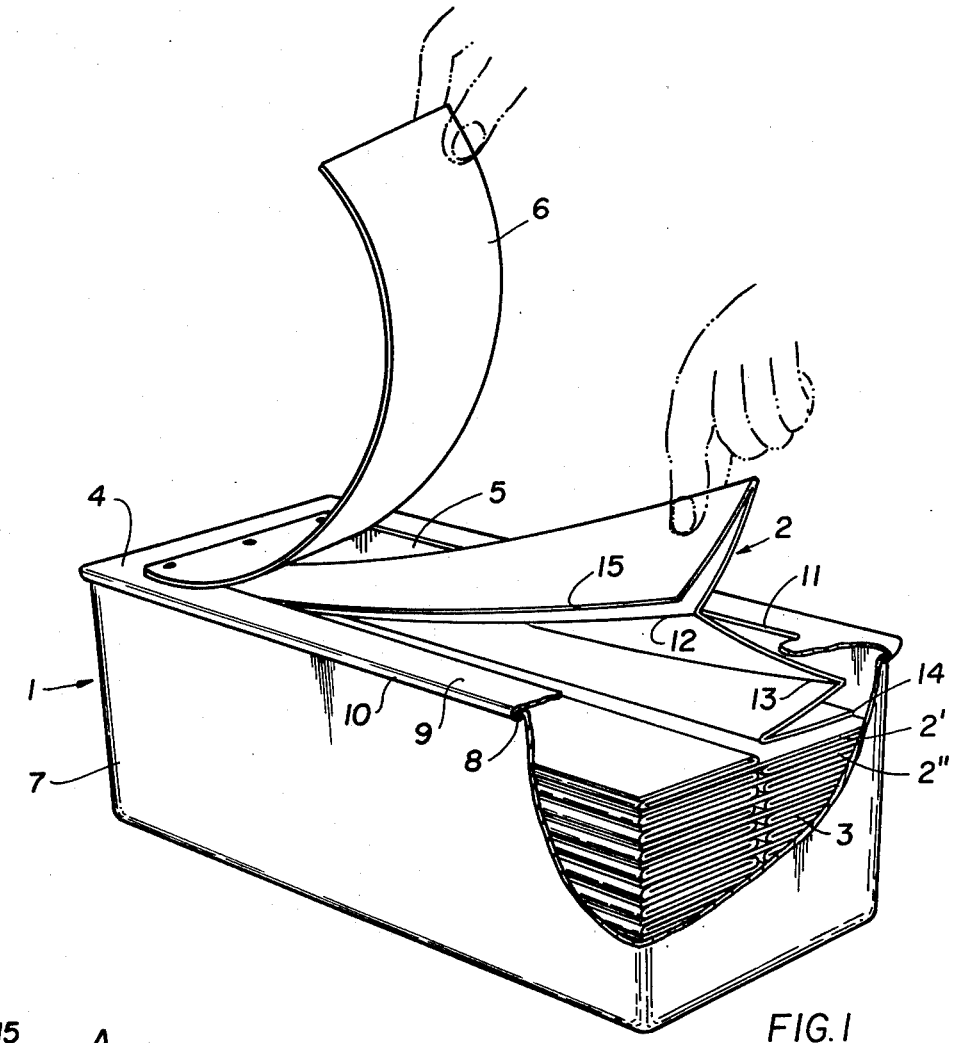
FIG. 1 is a perspective view of a preferred embodiment of the pack with an upper corner removed for the sake of clarity.

The present invention is illustrated for simplicity and brevity in the drawing, in connection with a box or pack shown and claimed in the copending parent application. The tissue is described as being a wet-tissue. Except as a vehicle for such illustration it is to be appreciated that the present invention for folding the tissue can be employed in any box form and even with dry tissues.

The cleansing tissue pack shown in the drawing comprises a parallelepiped box 1 of moisture-proof material and a plurality of moistened wet-tissues 2, 2', 2'' packed in the box, which abut each other in direct contact to form a stack 3. The moisture-proof material preferably consists of a diffusion-tight plastic which is inert to the components of the moisturizing solution.

The wet-tissues may consist, for example, of paper cloths or cloths of non-woven material which, if they are to be used as cleansing tissues, are impregnated with a cleansing, antiseptic solution, usually of about 15% ethanol solution containing a bactericide, such as trichlorohydroxyphenylether or cetypyridine chloride, and a component reducing surface tension, for example an amphoteric tenside. The solution may also contain substances beneficial to the skin, such as lanolin and isopropylmyristat and perfume elements such as menthol.

The box 1 is provided in its upper surface 4 with an opening 5 which is normally tightly sealed by means of a substantially tongue-shaped sealing member 6, also consisting of moisture-proof material. In order during the manufacture of the pack to facilitate the insertion of a stack of wet-tissues into the box, this is suitably provided with a drawer-part 7 as shown in the drawing, having a turned-back edge 8, and a lid 9 with a folded edge 10 which is snapped over the edge 8 so as to be moisture-tight. The opening 5 is thus arranged in the lid 9 and the tongue-shaped sealing member 6 is attached at one end to the upper surface 4 of the lid and is of such length and breadth that it covers the opening 5. At least the section of the sealing member 6 which abuts the edge zone 11 limiting the opening 5 when the box 1 is closed consists of an elastomeric sealing material such as rubber. Furthermore, the sealing member 6 is constructed so that it is sufficiently heavy to form the sealing material so that a substantially moisture-tight seal is obtained when the sealing member 6 abuts the edge 11 of the opening. The opening 5 can thus be exposed by lifting the free end of the sealing member 6 and resealed by lowering said free end.

The sealing member 6 consists of a tongue-shaped rubber sheet which is stapled or glued at one end to the lid 9. The rubber sheet 6 is of such a thickness that it is sufficiently heavy to provide a seal against the edge 11 and also to be self-carrying over the opening 5. A rubber sheet having a thickness of around 3–4 mm fulfils these requirements. However, the requirements can also be fulfilled by other designs for the sealing member. In another embodiment, for example, the rubber sheet 6 is thinner and is provided on its lower side with a reinforcing member of suitable weight which fits in the opening 5. Such a reinforcing member may suitably consist of a stiff plastic sheet stapled or attached in some other way to the rubber sheet. The reinforcing member may equally well be applied to the upper side of the rubber sheet and in this case it is preferably the same width as this for aesthetic reasons. However, it must be somewhat shorter than the rubber sheet so that this may act as a hinge at the attached end. In the latter case, the rubber sheet may be replaced, if desired, by a rectangular frame of rubber, one short side of which has such a width, seen along the long side of the rectangle, that the rubber frame can be attached to the lid of the box and act as a hinge.

The drawings show an embodiment of the cleansing tissue pack according to the invention, which is particularly attractive to the customer. In this embodiment the opening 5 is located centrally in the lid 9. The wet-tissues, which have a width slightly less than three times the internal width of the box and a length negligibly less than the internal length of the box, are suitably folded in a special manner which makes it extremely easy for the consumer, after lifting the free end of the sealing member, to take hold of a wet-tissue and lift it out of the box.

Figure 2:
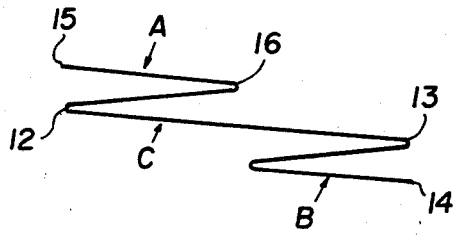
FIG. 2 is a diagram showing in principle how the tissue is folded.

Each tissue is folded, as can be seen clearly in FIG. 2, so that initially it is imagined to be folded along the folding lines 12, 13, this producing three layers A, B and C, one above the other. The free edge 14 of the lower layer B is then folded back to alignment with the fold 13 and the free edge 15 of the upper layer A is folded back to alignment with the fold 12. A tissue folded in this way is extremely easy to take hold of and saves space. Thus a tissue is obtained which, in the cross section shown, has two substantially Z-shaped sections on each side of the central plane C of the tissue. Alternatively, the tissue may be folded so that both the Z-shaped sections are located on the same side of the central plane C.

In either manner of folding the tissue the overlying or underlying Z-shaped sections have a fold line 16 which extends toward the central longitudinal axis of the central planar portion, so that the entire tissue when folded has contiguous sections which form a uniform thickness over its area, allowing it to be easily and uniformly stacked in the box. Further, the fold line 16 is more easily grasped because of its doubled thickness, than the edge of the tissue and thus enables the tissue to be more readily removed from the box. The single edges of the tissue remain hidden in the box and thus cannot be inadvertently torn, creased or otherwise destroyed.

What is claimed:

1. A tissue pack comprising a substantially closed parallelepiped container having a longitudinally elongated central opening in the top wall and a plurality of individually folded tissues located therein, each of said tissues being individually folded to form in cross section a substantially planar center portion having two substantially Z-shaped sections folded contiguously therewith along each edge thereof, said Z-shaped sections being formed along first fold lines parallel to the longitudinal center of said tissue located equidistant from each of the longitudinal edges forming three layers one on top of the other, the free edges of the sheet having second folds equidistant from the first fold lines to form a lower layer, a middle layer and an upper layer of substantially equal size, the free edges lying adjacent their respective first folds and the second folds lying substantially along the longitudinal center of the tissue, said side sections being folded to respectively lie above and below said center portion so that when said folded tissues are stacked one on top of the other within said container the second fold of the upper Z-shaped section of each tissue lies beneath the opening of the top wall and the second fold of the lower Z-shaped section lying adjacent the second fold of the upper Z-shaped section of the tissue lies directly below it in the stack, to thereby provide upper and lower Z-shaped sections of adjacent tissues in the same plane.

2. The pack according to claim 1 wherein the width of each of said tissues is approximately three times the internal width of said container, and each of the side sections and said center planar portion are each approximately one-third of said width of said tissue.

* * * * *